US005374217A

United States Patent [19]

Olson

[11] Patent Number: 5,374,217

[45] Date of Patent: Dec. 20, 1994

[54] ILLUSION CREATING FOR AMUSEMENT AND EDUCATION

[76] Inventor: Richard A. Olson, Apt. 4, 2511 Knight Dr., Grand Forks, N. Dak. 58201

[21] Appl. No.: 834,619

[22] Filed: Feb. 12, 1992

[51] Int. Cl.[5] ..... A63J 5/00

[52] U.S. Cl. ..... 472/57; 446/232; 273/112

[58] Field of Search ..... 472/57; 446/170, 168, 446/232; 40/427; 273/112; 434/302; 177/225, 232; 267/166.1, 150, 298

[56] References Cited

U.S. PATENT DOCUMENTS

| | | | |
|---|---|---|---|
| 2,596,688 | 5/1952 | Hinsen | 273/112 |
| 2,662,336 | 12/1953 | Zalkind | 446/170 |
| 3,028,704 | 4/1962 | Rumbaugh | 273/112 X |
| 3,610,624 | 10/1971 | Fleischer | 446/170 |
| 4,214,747 | 7/1980 | Rebajes | 472/57 |
| 4,595,369 | 6/1986 | Downs | 446/170 X |
| 4,916,752 | 4/1990 | Thompson | 40/427 |

FOREIGN PATENT DOCUMENTS

| | | | |
|---|---|---|---|
| 1077502 | 11/1954 | France | 273/112 |
| 8708 | of 1899 | United Kingdom | 273/112 |

*Primary Examiner*—James L. Ridgill, Jr.
*Attorney, Agent, or Firm*—Jerold M. Forsberg

[57] ABSTRACT

A device for creating an illusion includes a helix and an object in an arrangement which gives the illusion that the object and helix move relative to one another as the helix is rotated. The helix can be flexible or of a stable configuration such that it can be free standing. Support for the device can include a base or a swivel arrangement for suspending the device. The device can be free to rotate in moving air and, in situations where there are lesser amounts of air flow, a fan can be attached to the helix. Where there is an absence of moving air an electric motor can be employed. Variations in the arrangement and size of the components of the device can create variations in the illusion of relative movement. The use of colors and materials which glow in the dark in situations where there is low light, along with variations in lighting, will also vary the illusion of relative movement.

57 Claims, 4 Drawing Sheets

ILLUSION CREATING FOR AMUSEMENT AND EDUCATION

BACKGROUND OF THE INVENTION

The present invention relates generally to decorative and educational devices, and more specifically to devices which create an illusion for an observer when the devices are rotated.

Rotating and helical devices for amusement and advertising are generally well known and include such artifacts as the common barber-poll, decorative wind socks, and wind streamers. Other known helical arrangements include a ball and helical tubing game apparatus as depicted in U.S. Pat. No. 3,610,624. Another known arrangement is an educational and amusement device utilizing helical tubing and moveable members, depicted in U.S. Pat. No. 4,595,369. A simple rotatable helical ornament is depicted in U.S. Pat. No. 2,197,577, and an advertising device utilizing bright colors and a helix for holding an object is depicted in U.S. Pat. No. 1,821,021. Other helical display devices include a device having two helices wound from a single tubular-like material about a common axis, depicted in U.S. Pat. No. 4,916,752, and a device which can assume an infinite number of relative positions while maintaining the shape of a particular geometric form, depicted in U.S. Pat. No. 4,214,747. Clearly, as will become more apparent from an understanding of the instant invention, none of the prior art devices teach the concept of an illusion creating device as taught herein.

SUMMARY OF THE INVENTION

The overall object of the present invention is to provide a rotatable device which, because of the arrangement of the components, when combined with rotational motion imparted thereto, creates an illusion for an observer which is a perception of movement of the components relative to one another. In particular, the disclosed concept involves an illusion of movement of a helix, an object, or both, in the direction of extension of the central axis of the helix when in fact there is no linear movement of any of the components along the axis. The purpose for creating the illusion is to provide enjoyment and to create an aesthetically pleasing perception which is both entertaining and educational. Ideally, devices constructed in accordance with the principles of this invention are such that they can be used in living areas both inside and outside, in areas where there may or may not be moving air, and where there is either bright light or low light. Accordingly, universal devices can be constructed to accommodate the variables encountered in any living or business environment or a device may be designed to be limited to use in a particular situation, e.g., a device located on a desk in an office where there is bright light and no air flow.

A number of embodiments incorporating the principles of the instant invention are shown as including a helix and an object disposed in a manner such that there is an illusion of relative movement between the helix and the object as the device is rotated. A device constructed in accordance with the principles of the invention can utilize a helix which is flexible or a helix which is constructed of materials that cause it to be of a generally fixed configuration such that it can be free standing. The various ways to support a device embodying the concepts of this invention include suspending the device or positioning the device on a base. A device employing a flexible helix would of necessity be suspended while a device utilizing a generally rigid helix can either be suspended or supported by a base. No matter what manner of support for the device is employed, it is the rotation of the device, manually, by air movement, or by mechanical or electro-mechanical means, that causes the helix to cooperate with an object positioned relative thereto to produce an illusion for an observer. One embodiment of the device includes a ball supported by a helix and gives the illusion of movement of the ball relative to the helix when the device is rotating. In a series of similar embodiments, the object is another helix which can be fixed to the first helix and rotate therewith or which can be suspended separately and rotate independently either in an opposite direction or in the same direction as the first helix. In either case, the helical object appears to move relative to the first helix along the longitudinal axis of the first helix at a different rate than the first helix appears to be moving along the axis.

It is contemplated that the object may be of any size, may be symmetrical or of an irregular shape, including being shaped like an animal or a human being, and may be either positioned relative to the helix by being hung independently so as not to rotate or by being supported by the helix to rotate therewith. It is also contemplated that the helix or helices and the object or objects can be of different colors and/or of materials which will glow in the dark. Selection of particular colors and the use of light can vary the illusion being perceived and, of course, the illusion perceived may be different for each person, depending on conditions and variables. As will become apparent from reading and understanding this application, there are many forms that the invention may take and only a few have been discussed in detail.

Accordingly, it is a principle object of the present invention to provide a device which creates an illusion for amusement and education when rotating.

A further object of the invention is to provide a device that includes a generally helical portion which when rotating cooperates with an object disposed relative thereto to give the illusion that one or both of the object and helical portion are moving relative to the direction of extension of the central axis of the helical portion.

Another object of the invention is to provide a device that includes a generally helical portion which when rotating cooperates with an object disposed proximate thereto to give the illusion that the object and the helix are moving relative to one another.

Yet another object of this invention is to provide an illusion creating device which overcomes the inadequacies of prior art devices and which can be economically manufactured.

These and other objects and advantages of the present invention will be apparent and understood from the following detailed description when taken in conjunction with the accompanying drawings.

BRIEF DESCRIPTION OF THE DRAWINGS

Illusion creating devices constructed in accordance with the principles of this invention are described hereinbelow with reference to the accompanying drawing, wherein.

DETAILED DESCRIPTION OF THE INVENTION

Figure 1:
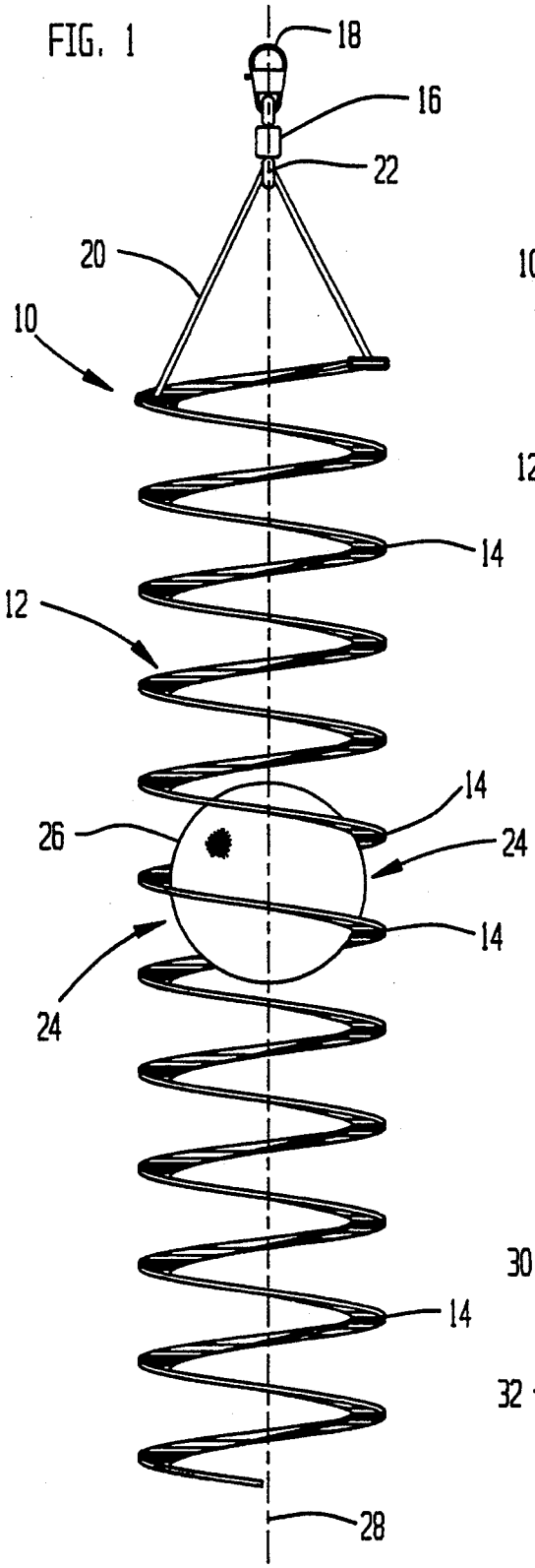
FIG. 1 is an elevation view of one embodiment of a suspended illusion creating device embodying the concepts of the instant invention.

It should be noted that like reference numerals are used throughout the various views to designate similar elements or components.

Referring now to FIG. 1, a rotatable device 10 embodying the concepts of the instant invention is depicted as including a helix 12 having a plurality of repetitive turns 14. Helix 12 is rotatably suspended by a swivel 16 having a hook 18 at one end for attachment to suitable supporting structure. Flexible line 20, attached to the helix 12 by any suitable means including gluing, is slideably received through a ring 22 to freely suspend the helix 12 from the swivel 16. An object 24, generally shown in this FIG. as being a ball, is supported by helix 12 and is, in its preferred form, a light weight plastic spheroid having an outer surface 26 of a predetermined diameter. Helix 12, preferably made of a rigid plastic, has a central axis 28 around which a generally flat band forms repetitive turns 14 all being generally the same size and generally spaced the same distance from one another. For purposes of understanding, a repetitive turn is considered to be a piece of the helix which extends continuously for 360°. In this embodiment, helix 12 has predetermined inside and outside diameters such that the inside diameter is less than and the outside diameter is greater than the predetermined diameter of the outer surface 26 of object 24. The spheroid or the helix or both have sufficient resiliency to permit the spheroid to be inserted between adjacent repetitive turns such that the spheroid is retained relative to the helix by at least a portion of the inside diameter of at least one repetitive turn engaging the outer surface 26. Ideally, the band width of the repetitive turns of the helix is wide enough to catch moving air and cause the helix to rotate about central axis 28. Alternatively, the device can be rotated manually. The illusion created by the device depicted in FIG. 1 will be discussed later.

Figure 2:
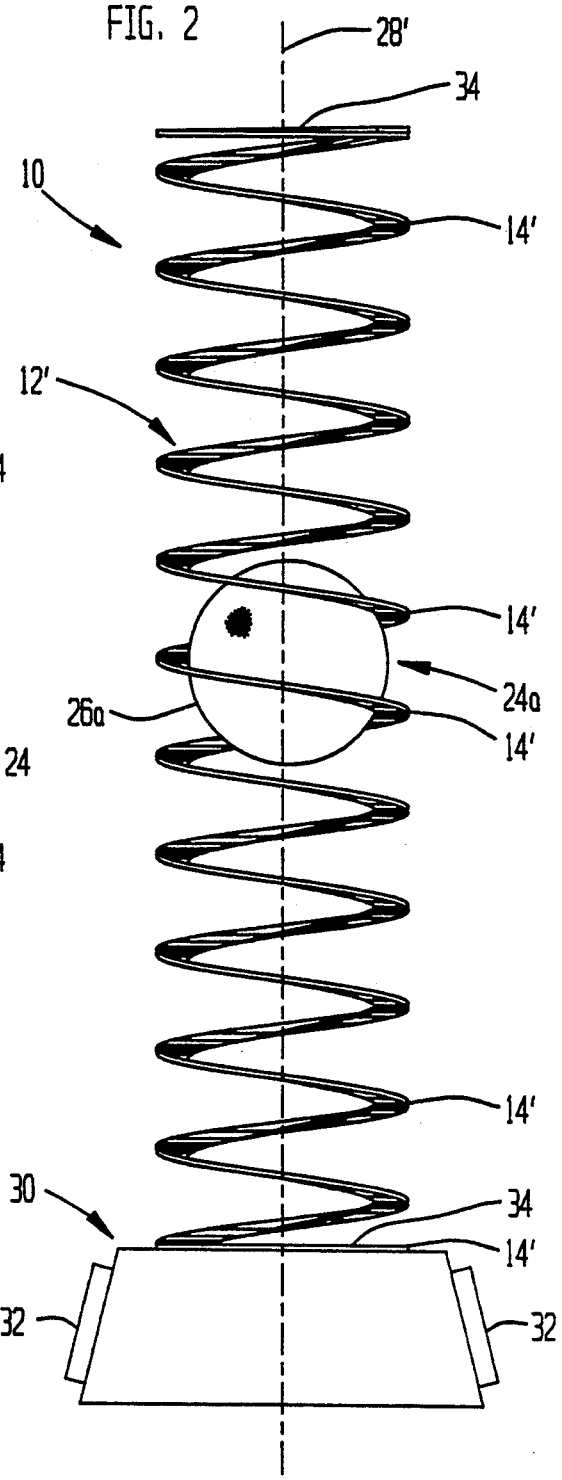
FIG. 2 is an elevation view of another embodiment showing a free standing illusion creating device rotatably mounted on a base.

Referring now to FIG. 2., an embodiment is depicted as including a helix 12′ and an object 24*a*, related in a manner similar to the helix and object shown in FIG. 1. However, the embodiment shown herein includes a free standing and self-supporting helix 12′ having a generally stable helical configuration rotatably supported on a base 30. Helix 12′ includes repetitive turns 14′ dimensioned and aligned in the manner as discussed with regard to FIG. 1. Base 30 includes an electric motor (not shown) operable in conjunction with batteries (not shown) or solar cells 32 or both. This embodiment also shows helix 12′ having the repetitive turn at each end modified to provide an end base 34 which is generally perpendicular to the central axis 28′ of the helix 12′. End base 34, at the lower end of helix 12′, is rotatably engaged by the electric motor (not shown in detail) for rotating the device. This configuration is particularly adapted for use in areas where there is normally insufficient air flow to rotate a suspended device. The illusion created by this embodiment is essentially the same as the illusion created by the embodiment depicted in FIG. 1 and will also be discussed in detail later.

Figure 3:
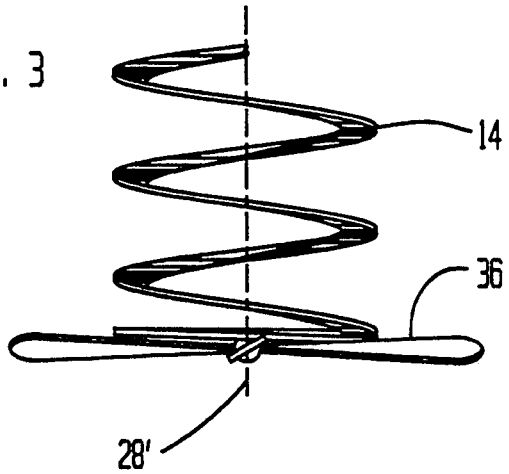
FIG. 3 is a partial view of a lower end of a suspended device showing one form of a fan attached to the helix.
Figure 4:
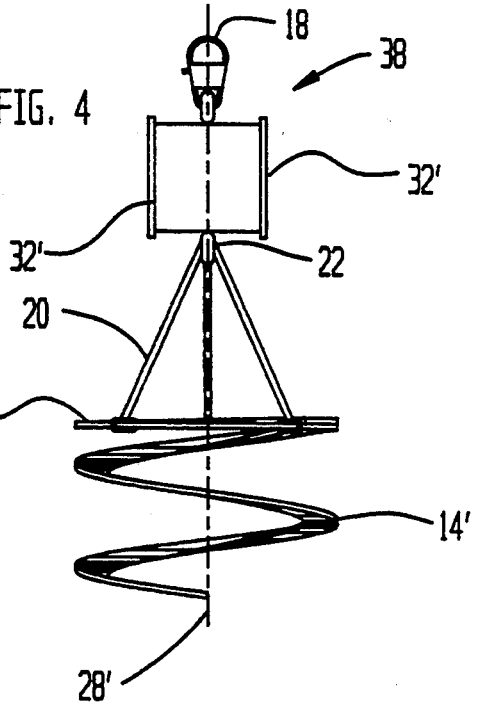
FIG. 4 is a partial view of an upper end of a suspended device showing an electric motor for inducing rotation.

Referring now to FIGS. 3 and 4, other means for inducing rotation of a suspended device about the central axes 28, 28′ are shown as including a fan 36, which can be attached to helix 12 or 12′ by any suitable means, including gluing, and an electric motor 38, disposed between hook 18 and ring 22, operable in conjunction with batteries (not shown) or solar cells 32′. It is contemplated that fan 36 can be designed to transfer additional rotational forces to the device from air moving either transverse to the central axis, e.g., wind, or from air moving parallel to the central axis, e.g., air rising from a register of a heating system for the room in which the device is suspended.

Figure 5:
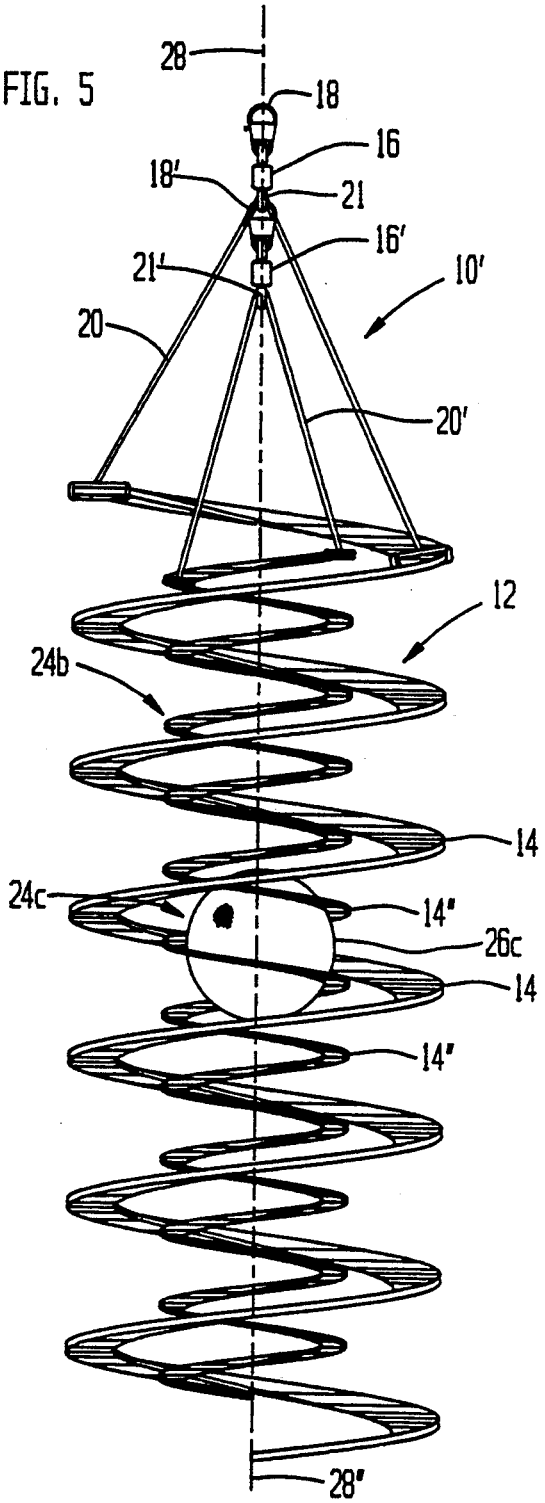
FIG. 5 is an elevation view of another embodiment of the suspended device showing an object in the form of a helix which in turn supports another object.
Figure 6:
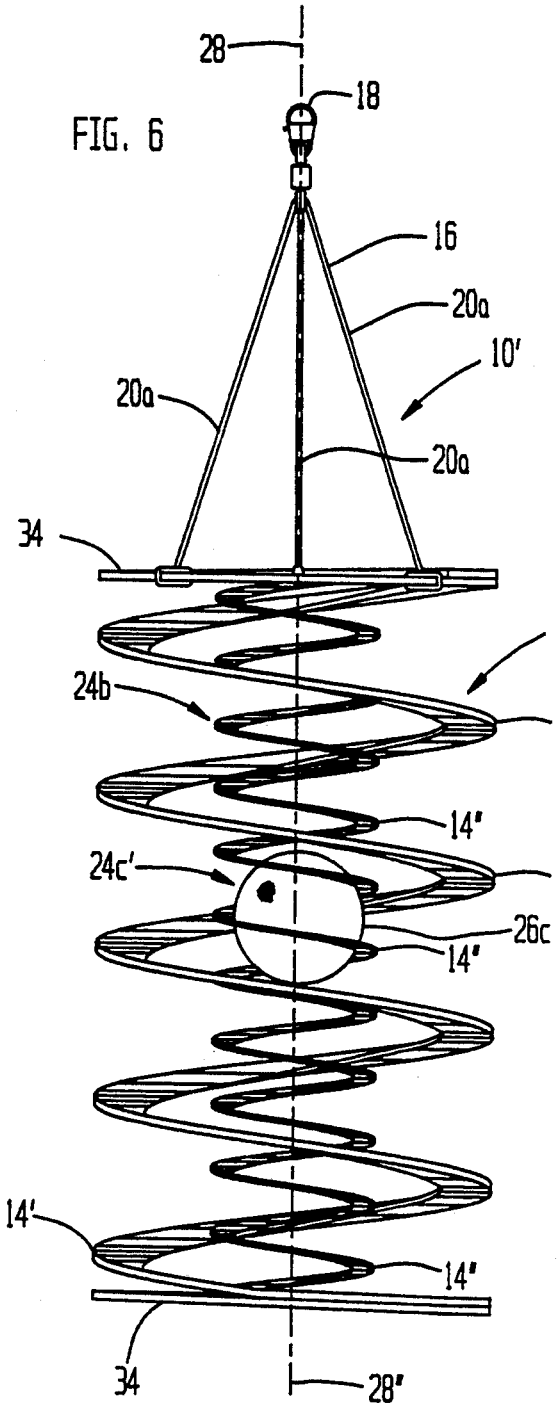
FIG. 6 is an elevation view of an embodiment similar to the embodiment shown in FIG. 5 except that the repetitive turns of the helical object extend in generally the same direction as the repetitive turns of the helix.

The embodiments depicted in FIGS. 5 and 6 include a helix 12 with repetitive turns 14 surrounding an object 24*b* which is generally in the configuration of another helix. Helical object 24*b* includes a plurality of repetitive turns 14″ about a central axis 28″ aligned with central axis 28, wherein the repetitive turns 14″ are all substantially the same size and aligned with one another at equal spacings to form a uniform helix. As discussed above, the repetitive turns 14 of helix 12 are all the same size and aligned with one another to form a uniform helix and have a predetermined inside diameter. The repetitive turns 14″ of helical object 24*b*, have predetermined inside and outside diameters such that the outside diameter is less than the inside diameter of helix 12 and another object 24*c*, depicted generally in the shape of a spheroid, with a predetermined outside diameter 26*c* larger than the predetermined inside diameter of the helical object 24*b*, can be positioned relative to the helical object 24*b* in the manner as discussed with regard to helix 12 and object 24 in FIG. 1. Helix 12 and helical object 24*b* can be attached to one another by any suitable means so as to rotate together as one (see FIG. 6), or can be independently and rotatably suspended by swivels 16 and 16′, respectively (see FIG. 5). As seen in FIG. 5, the helical object 24b can have its repetitive turns extend downward in a different direction than the repetitive turns of helix 12, i.e., the helices are the reverse of one another, or as seen in FIG. 6, the repetitive turns 14 of helix 12 and the repetitive turns of the helical object 24b can extend in generally the same direction. The support for the device depicted in FIG. 5 includes a pair of swivels 16 and 16' cooperating with flexible lines 20 and 20' attached to the helix and helical object, respectively, by any suitable means. The helix and helical object shown in FIG. 5 are independently rotatable and are generally of the configuration of the helix shown in FIG. 1. The support for the device depicted in FIG. 6 includes generally rigid links 20a (not shown in detail) which clip at one end to the end base 34 of the helix 12' and are connected to the swivel at their other end. Of course, the devices depicted in these embodiments could be supported by a base and utilize other means for inducing rotation such as an electric motor. The illusion created by these embodiments will be discussed below.

Figure 7:
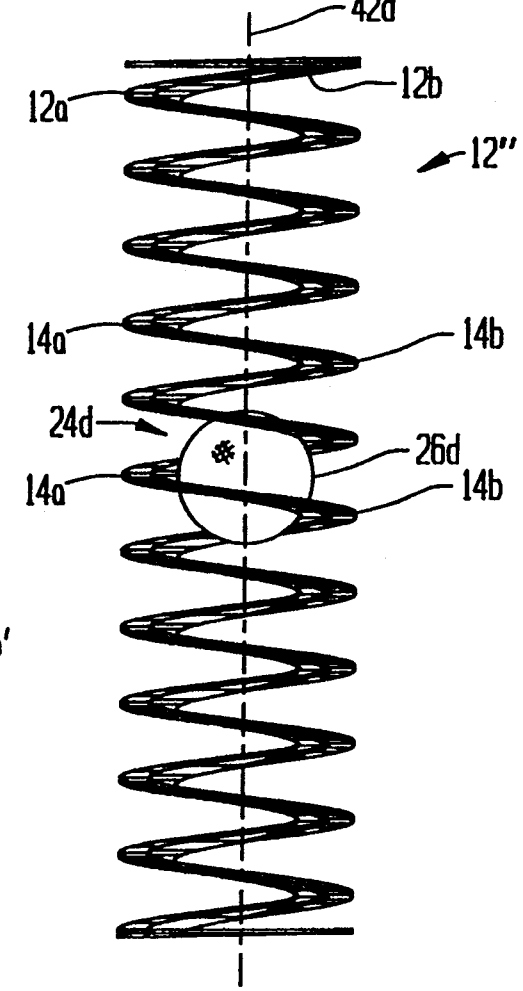
FIG. 7 is an elevation view of another embodiment, a support arrangement not being shown, incorporating a pair of nested helices and an object.
Figure 7A:
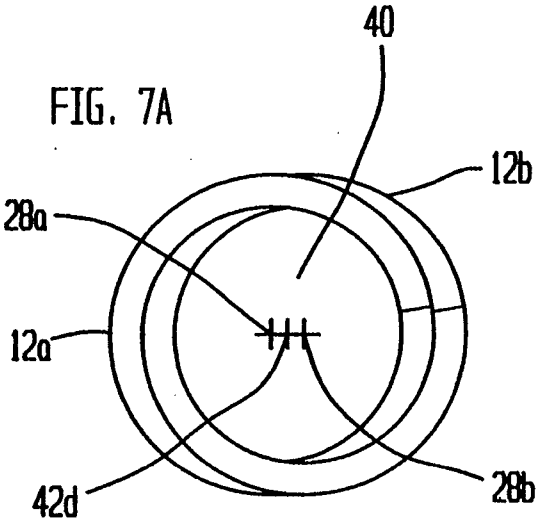
FIG. 7A is an end view of the helical arrangement as shown in FIG. 7.

Referring now to FIGS. 7 and 7A, helix 12'' is formed by a pair of helices 12a and 12b. Each of the helices 12a and 12b includes repetitive turns 14a and 14b, respectively, which are all substantially the same size and aligned such that when the helices 12a and 12b are nested and fixed relative to one another the central axis 28a and 28b, respectively, of each helix 12a and 12b are parallel and off-set and an area 40 defined by the inside diameters of helices 12a and 12b is generally elliptical in cross-section (see FIG. 7A). In this arrangement an object 24d is securely retained by portions of the inside diameters of repetitive turns 14a and 14b of the pair of helices 12a and 12b engaging an outer surface 26d of object 24d such that a central axis 42d of the object 24d is disposed between the parallel and off-set central axes 28a and 28b of the helices 12a and 12b. Again, object 24d is preferably larger in diameter than the inside diameter of helices 12a and 12b.

Figure 8A:
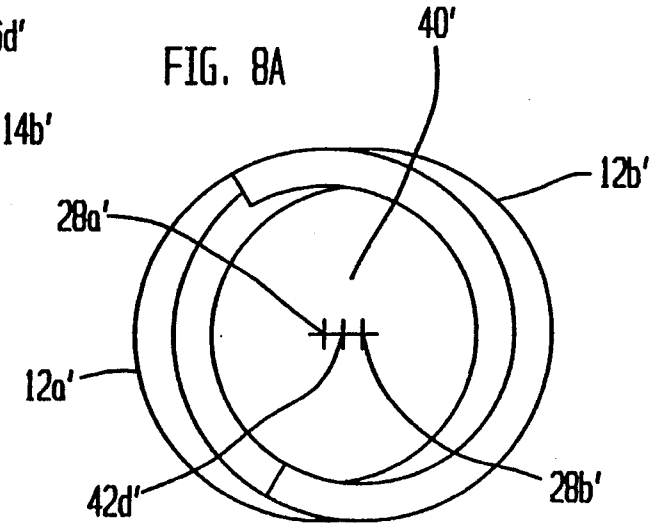
FIG. 8A is an end view of the helical arrangement as shown in FIG. 8.
Figure 8:
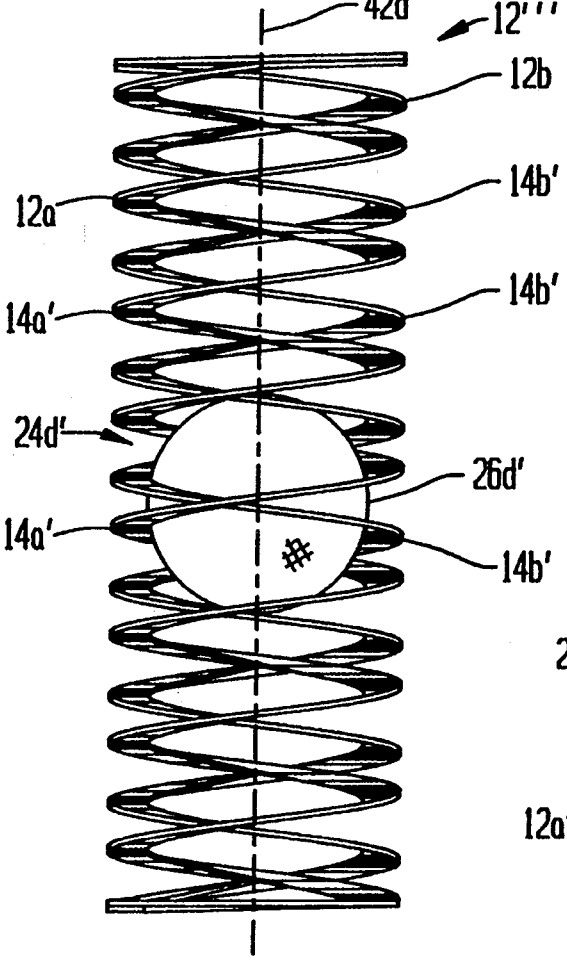
FIG. 8 is an elevation view of an embodiment similar to the embodiment shown in FIG. 7, a support arrangement not being shown, except that the repetitive turns of one helix of a pair of helices extend generally in a different direction than the repetitive turns of the other helix of the pair.

The embodiment depicted in FIGS. 8 and 8A is similar to the embodiment seen in FIGS. 7 and 7A in that helix 12''' includes a pair of helices 12a' and 12b'. The difference being that the repetitive turns 14a' of helix 12a' extend in a first direction and the repetitive turns 14b' of helix 12b' extend in a different direction such that the helical configurations of the two helices are mirror images of each other. When the helices 12a' and 12b' are nested and fixed relative to one other the repetitive turns 14a' of helix 12a' cross the repetitive turns 14b' of helix 12b' and an area 40', generally elliptical in cross-section, is defined (see FIG. 8A). An object 24d' is securely retained relative to helix 12''' by portions of the inside diameters of the repetitive turns 14a' and 14b' of each helix 12a' and 12b' engaging an outer surface 26d' of object 24d' such that a central axis 42d' of the object is disposed between the respective parallel and off-set central axes 28a' and 28b' of helices 12a' and 12b'.

It being understood that the support for the embodiments shown in FIG. 7 and FIG. 8 can be anything which will either cause or permit them to rotate, e.g., the means shown in FIGS. 2 and 4. The illusions created by the embodiments depicted in FIGS. 7 and 8 will be discussed later.

Figure 9:
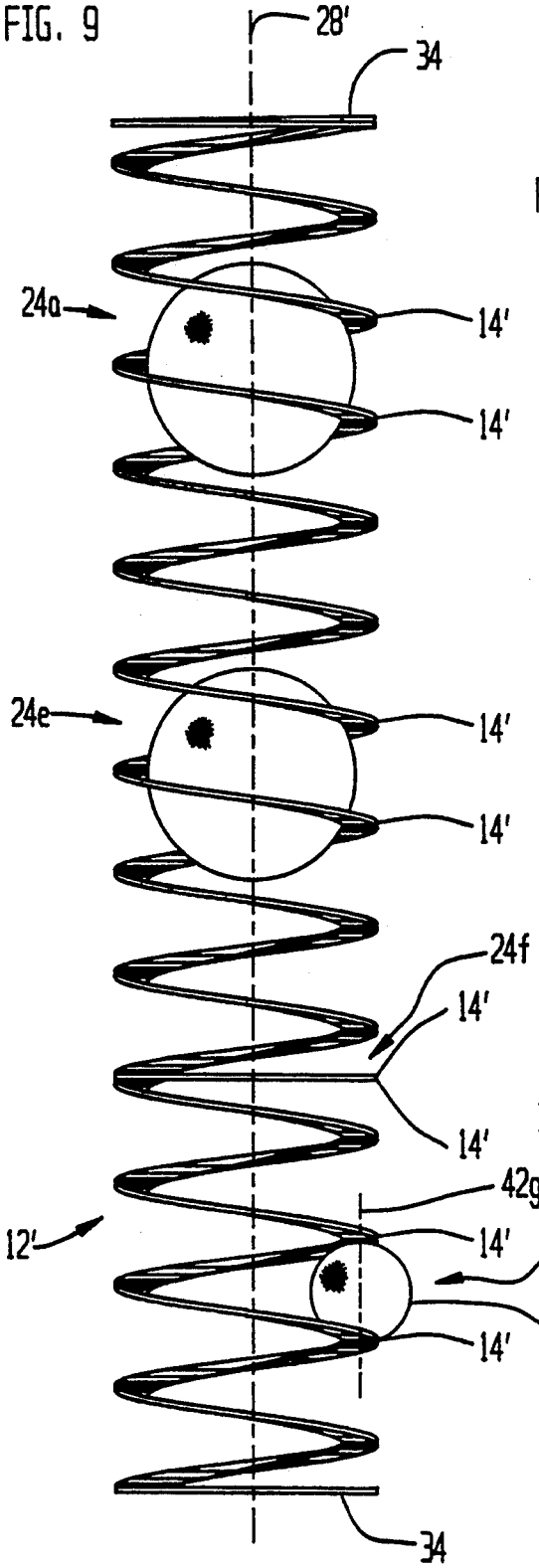
FIG. 9 is an elevation view of a device including three embodiments of the invention in one view, i.e., a second object is disposed relative to a first object and the helix, an object in the form of an irregularity in the helix is created by portions of at least two of the repetitive turns being secured together, and an object is generally aligned with the repetitive turns.

Referring now to FIG. 9, the device depicted includes three different embodiments and is shown utilizing a helix 12' as depicted in FIG. 2. One of the embodiments includes two objects 24a and 24e spaced along and aligned with the longitudinal axis 28' of helix 12'. A second embodiment includes an object 24f formed by an irregularity in helix 12'. The irregularity is comprised of portions of at least two repetitive turns 14' of helix 12' being juxtaposed and secured relative to one another by any suitable means, e.g., gluing, thereby forming an irregularity extending generally transverse to axis 28'. Finally, an embodiment is depicted where an object 24g having a central axis 42g and an outside diameter 26g, which is generally the same as the distance between juxtaposed equally spaced repetitive turns 14', is disposed such that the central axis 42g is generally aligned with repetitive turns 14' of helix 12'. The illusions created by these and the other embodiments will now be discussed.

The concept of the device is the creation of an illusion of movement as the device rotates. The illusion of movement is generally in the direction of extension of the central axis of the helix and involves the helix, an object, or both. Depending on the direction of rotation of the device and depending on the arrangement of the object and helix, movement of individual components may appear to be upward, downward, or they may appear to be suspended when the central axis of the device is oriented vertically. In the embodiment of FIG. 1, the device is rotated either manually or by air movement and, depending on the direction of rotation, the spheroid appears to move relative to the helix along the central axis, even though the object is fixed relative to the helix and the central axis. In FIG. 2, the electric motor in the base will rotate the device and create the same type of illusion as the one created by the rotation of the device in FIG. 1, e.g., the spheroid appears to move relative to the helix. When the repetitive turns extend in the direction as depicted in FIGS. 1 and 2, and the helix and object are arranged as in FIGS. 1 and 2, and the device rotates in a clockwise direction, when viewed from above, the object appears to move upward relative to the helix. When the device of FIG. 1 or FIG. 2 rotates in a counter-clockwise direction, when viewed from above, the object appears to move downward relative to the helix. This illusion can be changed completely by making the object smaller than the inside diameter of the helix and/or making the repetitive turns closer together. Where the object is smaller than the inside diameter of the helix it is preferable that it be supported by imperceptible means such that it may appear to be suspended and stationary as the helix rotates and appears to move relative thereto.

Where the object is a second helix positioned within the first helix, as in FIGS. 5 and 6, there is an illusion created of the helices moving relative to one another at different speeds because of the difference in size of each helix and the difference in the spacing of the repetitive turns of each helix. When the helices of this type of embodiment have the repetitive turns extend in different directions, the illusion created is of movement of each helix in opposite directions. The inclusion of additional objects in embodiments where one of the objects is a helix creates additional aesthetic qualities. Also, differences in the illusion created by this type of arrangement will result when the object and the helix rotate independently of one another, i.e., the relative speeds can vary more dramatically as will the apparent speed of movement in different directions.

In the embodiments using a pair of helices (FIGS. 7 and 8), the illusions created can be essentially the same and yet can vary depending on the focus of the observer. The device depicted in FIG. 7 can give the appearance of movement of the helices relative to one another while, at the same time, the spheroid moves relative to both. It is also possible for the helices to appear to be moving together while the ball is moving relative to both. The device seen in FIG. 8 can give the illusion that the ball either moves up or down no matter which direction the device is rotating depending on the focus of the observer. For example, when the device is rotated in a clockwise direction, when viewed from above, the object will appear to move upward relative to helix 28*b* and downward relative to helix 28*a* when the observer focuses on each respective helix relative to the object. When the device rotates in the opposite direction the same illusions will appear except that the movement of the object relative to each particular helix will be reversed.

As suggested in FIG. 9, the inclusion of multiple objects creates a slightly different illusion due to the apparent pursuit of one object by another. The direction of rotation will determine which object is being pursued. Of course, the objects could be humanoid forms or animal-like and be supported independent of the helix such that as the helix rotates one of the objects will appear to pursue the other. Further in regard to the irregularity in the helix depicted in FIG. 9, it is submitted that the irregularity can be interpreted as being the object and, as discussed in regard to FIG. 9, is formed by the securing of portions of at least two repetitive turns together. The illusion of movement is the same for an irregularity created by the secured together repetitive turns as for the object in FIGS. 1 and 2. A distinctive illusion is created when an object is generally aligned with the repetitive turns, e.g., like the small spheroid in FIG. 9. The illusion of movement in this arrangement is one in which the object appears to move relative to and along the repetitive turns in a generally helical path. In this situation the apparent direction of movement is also dependent upon the direction of rotation of the helix.

It is contemplated that the object can have an overall diameter which is less than the inside diameter of the helix making it necessary to support the object independently, e.g. using monofilament or a translucent rod. Where the object is of a smaller diameter, the helix can rotate independently while the object remains stationary resulting in a distinctive illusion. Depending on the spacing of the repetitive turns from one another, the object, e.g., when the repetitive turns are close together, may appear to be suspended in mid air without support as the helix appears to move relative thereto. Varying the spacing of the repetitive turns and the size of the object increases the number of illusions possible. It should be noted that a stationary object is not required to be symmetrical about the central axis of the helix. However, where the object rotates with the helix it is preferred that the object be symmetrical.

It is further contemplated that the helix and object can be made of materials of different colors and, in the embodiments involving more than one helix and more than one object, the components can all be of different colors and for low light situations be made of materials which glow in the dark. It is also contemplated that the illusion can be varied using lights, e.g., different colored lights along with a strobe. The best example is when different colored lights are used with a device, e.g., the device depicted in FIG. 8, and where the components are all different colors. One of the helices, 28*a* and 28*b*, can be made to essentially disappear and suddenly reappear as the other helix disappears as the lighting is changed, thereby causing the object to appear to move differently with each change of lighting.

The devices disclosed herein can be formed from any of a number of different materials and by any of a number of different processes.

While this invention has been described with a certain degree of particularity, it should be understood that other forms of illusion creating devices are contemplated by the present invention and it is manifest that many changes may be made in the details of construction and in the arrangement of components without departing from the spirit and scope of the disclosure. It is understood that the invention is not limited to the embodiments set forth herein for purposes of exemplification, but is limited only by the scope of the attached claims, including the full range of equivalency to which each element is entitled.

I claim:

1. A rotatable device for producing an illusion for amusement and education comprising an elongated element forming a coil with a plurality of repetitive turns about a central axis, an object, means supporting said object relative to said coil for non-linear movement in the direction of extension of said central axis, and means for supporting said coil permitting rotation of said coil about said central axis, whereby rotation of the coil about the central axis gives the illusion of movement of at least one of said coil and said object in the direction of extension of said central axis.

2. A device as set forth in claim 1 wherein said means for supporting includes means for suspending said coil and means for permitting said coil to freely rotate about said central axis when suspended.

3. A device as set forth in claim 1 wherein said object is generally symmetrical about said central axis.

4. A device as set forth in claim 3 wherein said object is a spheroid with an outer surface having a predetermined diameter which is greater than an inside diameter of said repetitive turns, said spheroid being retained relative to said coil and in alignment with said central axis by a portion of said inside diameter engaging said outer surface of said spheroid.

5. A device as set forth in claim 1 including a second object, means for supporting the second object relative to said helix and spaced from said first mentioned object.

6. A device as set forth in claim 5 wherein said means for supporting said second object positions said second object to give the illusion of the second object pursuing the first object as the device rotates.

7. A device as set forth in claim 1 including means for inducing rotation of said coil about said central axis.

8. A device as set forth in claim 7 wherein said means for supporting includes means for suspending said coil and said means for inducing rotation includes an electric motor.

9. A device as set forth in claim 7 wherein said coil is constructed of material such that said coil is a generally stable free standing helical configuration with spacing between said repetitive turns being generally constant and said means for supporting includes a base and said means for inducing rotation includes an electric motor in said base.

10. A device as set forth in claim 1 wherein the repetitive turns of said plurality of repetitive turns are substantially equal in size and aligned with one another thereby forming a generally uniform helix having a predetermined inside diameter and a predetermined outside diameter.

11. A device as set forth in claim 10 wherein said means for supporting includes means for suspending said helix and means for permitting said helix to freely rotate about said central axis when suspended.

12. A device as set forth in claim 10 including a second object, means for supporting the second object relative to said helix and spaced from said first mentioned object.

13. A device as set forth in claim 12 wherein said means for supporting said second object positions said second object to give the illusion of the second object pursuing the first object as the device rotates.

14. A device as set forth in claim 10 including means for inducing rotation of said helix about said central axis.

15. A device as set forth in claim 14 wherein said means for supporting includes means for suspending said helix and said means for inducing rotation includes an electric motor.

16. A device as set forth in claim 14 wherein said helix is constructed of material such that said helix is a generally stable free standing helical configuration with spacing between said repetitive turns being generally constant and said means for supporting includes a base and said means for inducing rotation includes an electric motor in said base.

17. A device as set forth in claim 10 wherein the object has a central axis and is disposed such that the central axis is generally aligned with the repetitive turns thereby giving the illusion that the object is moving relative to the direction of extension of said central axis and following the repetitive turns along a helical path as the device rotates.

18. A device as set forth in claim 17 wherein said means for supporting includes means for suspending said helix and means for permitting said helix to freely rotate about said central axis when suspended.

19. A device as set forth in claim 17 including means for inducing rotation of said helix about said central axis.

20. A device as set forth in claim 19 wherein said means for supporting includes means for suspending said helix and said means for inducing rotation includes an electric motor.

21. A device as set forth in claim 20 wherein said helix is constructed of material such that said helix is a generally stable free standing helical configuration with spacing between said repetitive turns being generally constant and said means for supporting includes a base and said means for inducing rotation includes an electric motor in said base.

22. A device as set forth in claim 10 wherein said object is generally spherical.

23. A device as set forth in claim 24 wherein said object is a spheroid with an outer surface having a predetermined diameter which is greater than said inside diameter of said helix, said spheroid being retained relative to said helix and in alignment with said central axis by a portion of the inside diameter of at least one repetitive turn engaging said outer surface.

24. A device as set forth in claim 23 wherein said means for supporting includes means for suspending said helix and means for permitting said helix to freely rotate about said central axis when suspended.

25. A device as set forth in claim 23 including means for inducing rotation of said helix about said central axis.

26. A device as set forth in claim 25 wherein said means for supporting includes means for suspending said helix and said means for inducing rotation includes an electric motor.

27. A device as set forth in claim 25 wherein said helix is constructed of material such that said helix is a generally stable free standing helical configuration with spacing between said repetitive turns being generally constant and said means for supporting includes a base and said means for inducing rotation includes an electric motor in said base.

28. A device as set forth in claim 25 wherein said means for supporting includes means for suspending said helix and said means for inducing rotation includes a fan attached to said helix, whereby air movement causes said fan to induce rotation said helix about said central axis.

29. A device as set forth in claim 10 wherein said object includes an elongated element forming a coil having a plurality of repetitive turns about a central axis for the object, said repetitive turns of said plurality of repetitive turns of said object being substantially equal in size and aligned with one another thereby forming a second generally uniform helix having an outside diameter which is less than the inside diameter of the first mentioned helix, and means for positioning the second mentioned helix within the first mentioned helix wherein said central axis of said object is aligned with the central axis of said first mentioned helix.

30. A device as set forth in claim 29 wherein spacing between adjacent repetitive turns of said first mentioned helix is greater than spacing between adjacent repetitive turns of said second mentioned helix whereby said repetitive turns of said first mentioned helix and the repetitive turns of the second mentioned helix give the illusion of movement along the aligned axes at different rates.

31. A device as set forth in claim 30 wherein said means for supporting includes means for suspending said helix and means for permitting said helix to freely rotate about said central axis when suspended.

32. A device as set forth in claim 30 including means for inducing rotation of said helix about said central axis.

33. A device as set forth in claim 32 wherein said means for supporting includes means for suspending said helix and said means for inducing rotation includes an electric motor.

34. A device as set forth in claim 32 wherein said first mentioned helix and said object are constructed of material such that they are generally stable free standing helical configurations with spacing between said repetitive turns being generally constant and said means for supporting includes a base and said means for inducing rotation includes an electric motor in said base.

35. A device as set forth in claim 29 wherein said plurality of repetitive turns of the first mentioned helix turn in a first direction and said plurality of repetitive turns of the second mentioned helix turn in a second direction whereby said first mentioned helix and said second mentioned helix appear to move in opposite directions when said device is rotated.

36. A device as set forth in claim 35 wherein said means for supporting includes means for suspending said helix and means for permitting said helix to freely rotate about said central axis when suspended.

37. A device as set forth in claim 35 including means for inducing rotation of said helix about said central axis.

38. A device as set forth in claim 37 wherein said means for supporting includes means for suspending said helix and said means for inducing rotation includes an electric motor.

39. A device as set forth in claim 37 wherein said first mentioned helix and said object are constructed of material such that they are generally stable free standing helical configurations with spacing between said repetitive turns being generally constant and said means for supporting includes a base and said means for inducing rotation includes an electric motor in said base.

40. A device as set forth in claim 10 wherein said device includes an elongated element forming a second coil with a plurality of repetitive turns about a second central axis, said repetitive turns of said plurality of repetitive turns of said second coil being substantially equal in size and aligned with one another thereby forming a second generally uniform helix having an outside diameter and an inside diameter which are substantially the same as that of the first mentioned helix, said repetitive turns of the second mentioned helix extending in the same direction as said repetitive turns of the first mentioned helix and said repetitive turns of the second mentioned helix being juxtaposed relative to said repetitive turns of the first mentioned helix and fixed relative thereto such that the first and second central axes are parallel and off-set relative to one another and the first and second helices rotate together as one.

41. A device as set forth in claim 40 wherein said juxtaposed repetitive turns of said first mentioned helix and said second mentioned helix define an area which is generally elliptical in cross-section and said object is generally symmetrical about a central axis for the object, said object having an outside surface with a diameter greater than the inside diameter of each of the first mentioned and said second mentioned helices, whereby said object is retained relative to the helices by a portion of the inside diameter of each of the helices engaging a portion of the outside surface of the object when the object is disposed with its central axis parallel to and between the off-set central axes of the helices.

42. A device as set forth in claim 40 wherein said means for supporting includes means for suspending said helices and means for permitting said helices to freely rotate when suspended.

43. A device as set forth in claim 40 including a second object, means for supporting the second object relative to said helix and spaced from said first mentioned object.

44. A device as set forth in claim 43 wherein said means for supporting said second object positions said second object to give the illusion of the second object pursuing the first object as the device rotates.

45. A device as set forth in claim 40 including means for inducing rotation of said helices.

46. A device as set forth in claim 45 wherein said means for supporting includes means for suspending said helices and said means for inducing rotation includes an electric motor.

47. A device as set forth in claim 45 wherein said helices are constructed of material such that they are generally stable free standing helical configurations with spacing between said repetitive turns being generally constant and said means for supporting includes a base and said means for inducing rotation includes an electric motor in said base.

48. A device as set forth in claim 10 wherein said device includes an elongated element forming a second coil with a plurality of repetitive turns about a second central axis, said repetitive turns of said plurality of repetitive turns of said second coil being substantially equal in size and aligned with one another thereby forming a second generally uniform helix having an outside diameter and an inside diameter which are substantially the same as that of the first mentioned helix, said repetitive turns of the second mentioned helix extending generally in a different direction to the direction in which the repetitive turns of the first mentioned helix extend, and said second mentioned helix being nested with and fixed relative to said first mentioned helix such that the first and second mentioned central axes are parallel and off-set relative to one another and respective repetitive turns of each of the helices are juxtaposed and crossing relative to one another wherein the first and second helices rotate together as one.

49. A device as set forth in claim 48 wherein said juxtaposed repetitive turns of said first mentioned helix and said second mentioned helix define an area which is generally elliptical in cross-section and said object is generally symmetrical about a central axis for the object, said object having an outside surface with a diameter greater than said inside diameter of each of the first mentioned and second mentioned helices, whereby said object is retained relative to the helices by a portion of the inside diameter of each of the helices engaging a portion of the outside surface of the object when the object is disposed with its central axis parallel to and between the off-set central axes of the helices.

50. A device as set forth in claim 48 wherein said means for supporting includes means for suspending said helices and means for permitting said helices to freely rotate when suspended.

51. A device as set forth in claim 48 including a second object, means for supporting the second object relative to said helices and spaced from said first mentioned object.

52. A device as set forth in claim 51 wherein said means for supporting said second object positions said second object to give the illusion of the second object pursuing the first object as the device rotates.

53. A device as set forth in claim 48 including means for inducing rotation of said helices.

54. A device as set forth in claim 53 wherein said means for supporting includes means for suspending said helices and said means for inducing rotation includes an electric motor.

55. A device as set forth in claim 53 wherein said helices are constructed of material such that they are generally stable free standing helical configurations with spacing between said repetitive turns being generally constant and said means for supporting includes a base and said means for inducing rotation includes an electric motor in said base.

56. A rotatable device for producing an illusion for amusement and education comprising an elongated element forming a coil with a plurality of repetitive turns about a central axis, said repetitive turns of said coil being generally the same size to thereby form a generally uniform helix, an irregularity in the form of a spheroid disposed along the length of said helix incapable of linear movement in the direction of extension of said central axis, means for supporting said spheroid relative to said helix, and means for supporting said helix, whereby rotation of the helix about the central axis gives the illusion of movement of at least one of said helix and said irregularity in the direction of extension of said central axis.

57. A rotatable device for producing an illusion for amusement and education comprising an elongated element forming a coil with a plurality of repetitive turns about a central axis, said repetitive turns of said coil being generally the same size to thereby form a generally uniform helix, an irregularity along the length of said helix incapable of linear movement in the direction of extension of said central axis, said irregularity being formed by portions of at least two turns of said plurality of repetitive turns being juxtaposed and secured relative to one another, and means for supporting said helix, whereby rotation of the helix about the central axis gives the illusion of movement of the irregularity relative to said helix in the direction of extension of said central axis.

* * * * *